US006226959B1

(12) United States Patent
Krasuski et al.

(10) Patent No.: US 6,226,959 B1
(45) Date of Patent: May 8, 2001

(54) FOLDING/INSERTING MACHINE INCORPORATING A SEPARATE PATH FOR INSERTS

(75) Inventors: Marek Krasuski, Fontenay Aux Roses; Christophe Bezelga, Sceaux, both of (FR)

(73) Assignee: Neopost Industrie (FR)

( * ) Notice: Subject to any disclaimer, the term of this patent is extended or adjusted under 35 U.S.C. 154(b) by 0 days.

(21) Appl. No.: 09/388,200

(22) Filed: Sep. 1, 1999

(30) Foreign Application Priority Data

Sep. 2, 1998 (FR) ..... 9810949

(51) Int. Cl.[7] ..... B65B 5/04
(52) U.S. Cl. ..... 53/117; 53/569
(58) Field of Search ..... 53/569, 460, 381.3, 53/117; 493/216

(56) References Cited

U.S. PATENT DOCUMENTS 4,668,212 * 5/1987 Kotani ..... 493/216
4,924,652 * 5/1990 Krasuski et al. ..... 53/569
5,333,437 * 8/1994 Conti ..... 53/381.3
5,507,129 * 4/1996 Joson et al. ..... 53/569
6,016,638 * 1/2000 Bernard et al. ..... 53/569
6,094,894 * 8/2000 Yates ..... 53/569

FOREIGN PATENT DOCUMENTS

185811 * 7/1986 (EP) ..... 493/216
0 352 692 A1 1/1990 (EP) .
2 757 841 A1 7/1998 (FR) .

* cited by examiner

*Primary Examiner*—Eugene Kim
(74) *Attorney, Agent, or Firm*—Sughrue, Mion, Zinn, Macpeak & Seas, PLLC

(57) ABSTRACT

The present invention relates to a folding and/or inserting machine comprising a first path coupled upstream to a document entry and downstream to a first entry of a folding module, a second path coupled upstream to an empty envelope entry and downstream to a first entry of an insertion module itself coupled downstream of an exit of the folding module, a third path coupled upstream to an exit of the insertion module and downstream to a filled and closed envelope exit, and a fourth path coupled upstream to a first advertizing insert or reply envelope entry and downstream to a second entry of the insertion module, and a fifth path coupled upstream to a second advertizing insert or reply envelope entry downstream to the second entry of the insertion module, the routing of the advertizing inserts or the reply envelopes along the fourth and fifth paths between the advertizing insert or reply envelope entries and the second entry of the insertion module being effected through the folding module without passage through the folding pockets.

5 Claims, 2 Drawing Sheets

FOLDING/INSERTING MACHINE INCORPORATING A SEPARATE PATH FOR INSERTS

FIELD OF THE INVENTION

The present invention relates to the field of processing mail. More particularly, it relates to a folding/inserting machine intended for folding and placing articles for mailing, such as documents of formats A4 or A5, reply envelopes or advertizing inserts, into envelopes.

BACKGROUND OF THE INVENTION

Machines for folding and inserting documents are industrial machines well known in the art.

European Patent Application No. 0 700 794 to PITNEY BOWES describes such a machine, which conventionally comprises document feeders, an empty envelope feeder and an advertizing insert feeder. As specified in column 1, lines 13 to 17 of this Application, the folding/inserting machine market is a highly competitive one in which any innovation, however small, is capable of influencing the behaviour of the purchasers. However, it will be noted that this machine is fairly voluminous and, by its design, with substantially horizontal tubs, it allows only a low capacity of loading of articles to be mailed. Applicants have therefore developed machines allowing much higher loading capacities. Two embodiments of such machines are given in European Patent EP 352 292 and French Patent Application FR 2 757 841. In addition, Applicants disclosed in their French Patent Application FR 97 13053 a novel architecture for the conveying paths of these machines, which are more reliable (particularly by limiting the sources of jamming) and present better performances.

However, it has appeared that, under certain particular conditions of use, this latter type of machine, like the earlier ones (cf. for example EP 0 700 794) might still present limitations. For example, it is, in practice, virtually impossible to insert both a reply envelope and an insert into the same empty envelope. In effect, the placing of such an article for mailing combining these two types of documents in an envelope supposes the use of a document feed tub by way of insert feeder (if the reserved path is for example used for a supply of reply envelopes), which presents at least three major drawbacks. Firstly, this modus operandi considerably reduces the functionalities of the machine by limiting the possibilities of combined feed of documents by the prevention of any simultaneous automatic operational mode. The document feed tubs, by their physical structures (in particular the dimensions of the margin stops and the drive means), cannot receive documents of too small a format, i.e. in practice a format smaller than format A5. Finally, the insertion of the insert is in that case no longer effected directly without fold in the insertion module, but after folds are made through the folding module, which raises a serious problem when this insert is made of cardboard.

It is an object of the present invention to provide a folding and/or inserting machine which allows such a combined insertion of reply envelopes and of inserts in the same empty envelope without presenting the drawbacks set forth hereinabove. A further object of the invention is to propose a machine which presents an increased capacity of loading.

SUMMARY OF THE INVENTION

These objects are attained by a folding and/or inserting machine of the type comprising a first path coupled upstream to a document entry and downstream to a first entry of a folding module, a second path coupled upstream to an empty envelope entry and downstream to a first entry of an insertion module itself coupled downstream of an exit of the folding module, a third path coupled upstream to an exit of the insertion module and downstream to a filled and closed envelope exit, and a fourth path coupled upstream to a first advertzing insert or reply envelope entry and downstream to a second entry of the insertion module, characterized in that it further comprises a fifth path coupled upstream to a second advertizing insert or reply envelope entry and downstream to the second entry of the insertion module, the routing of the advertizing inserts or the reply envelopes along the fourth and fifth paths between the advertizing insert or reply envelope entries and the second entry of the insertion module being effected through the folding module without passage through the folding pockets.

With this particular configuration integrating an additional path, the initial structure of the machine is preserved, but its possibilities of operation are further improved.

The second advertzing insert or reply envelope entry is preferably arranged beneath the first advertizing insert or reply envelope entry at the rear of the machine. The general space requirement of the machine is thus only slightly modified.

The first and second advertizing insert or reply envelope paths advantageously form a conveying path having a general Y configuration with a common terminal part which follows a substantially rectilinear path aligned with the second entry of the insertion module. This conveying path is formed by two half-conduits including a lower half-conduit articulated about a pin to allow access inside the conveying path after it has tipped downwardly.

According to a preferred embodiment, the lower half-conduit is provided with simple pressure rollers which cooperate with drive rollers fast with an upper half-conduit of the path conveying the advertizing inserts or reply envelopes and actuated from the control motor of the machine.

BRIEF DESCRIPTION OF THE DRAWINGS

The invention will be more readily understood on reading the following description with reference to the accompanying drawings, in which.

DESCRIPTION OF PREFERRED EMBODIMENT

Figure 2:
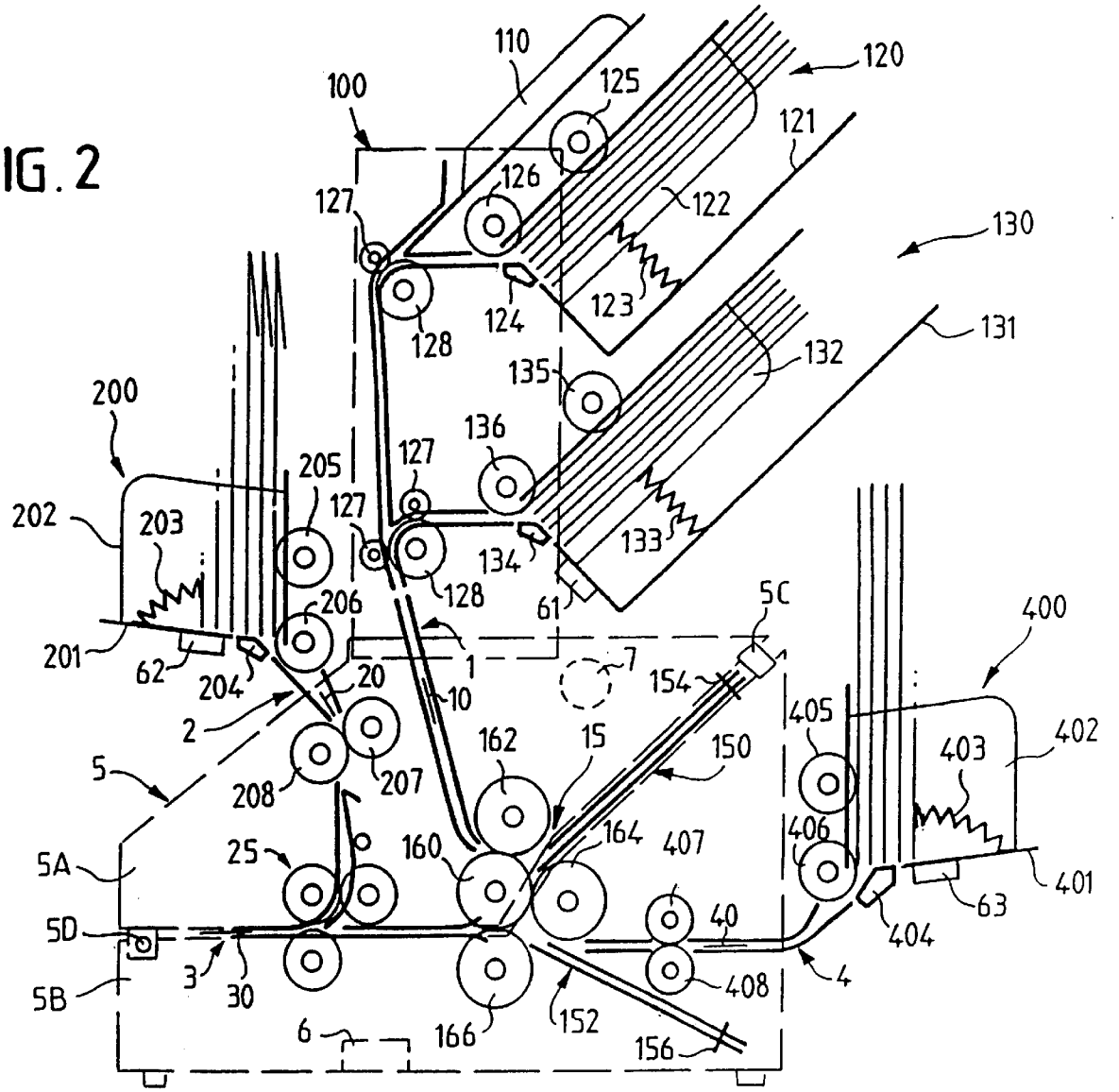

Referring now to the drawings, and firstly to FIG. 2, a folding and inserting machine serves to fold and place in an envelope articles to be mailed, such as documents, advertizing inserts and reply envelopes, preferably as these articles are produced. It forms part of the equipment of a secretary's station where it constitutes one of the machines available for the person working at that station. This machine is simply placed on the work surface and is easy to access, in particular for the presentation of the documents which this person is to place in envelopes.

The machine presents a document entry 1 located at the base of a principal document feeder 100 comprising for example a manual loading tray 110 for an admission of one to five sheets and two loading magazines (or tubs) 120, 130, an empty envelope entry 2 located at the base of a secondary envelope feeder 200 comprising an empty envelope magazine, an insert or reply envelope entry 4 located at the base of an auxiliary feeder 400 comprising an adverting insert/reply envelope magazine, and an exit 3 for filled and closed envelopes.

These different structural elements are formed on a machine chassis 5, itself formed in two parts, the so-called upper chassis 5A and lower chassis 5B. The lower face of the upper chassis is open and said upper chassis is mounted to pivot on the lower chassis with open upper face, about a pin 5D advantageously borne by the upper chassis, preferably at the level of its front part. Furthermore, the upper chassis 5A is locked on the lower chassis 5B which it closes by locking/unlocking means 5C preferably disposed at the level of its rear part. The empty envelopes are loaded in packets in the magazine 200. Similarly, the advertizing inserts or the reply envelopes are equally easily introduced in packets at the level of the magazine 400. As for the filled and closed envelopes, they are available at the level of the exit 3.

The document entry 1 and the empty envelope entry 2 are defined on the upper wall of the upper chassis 5A, with the entry 1 more to the rear than entry 2 (for example entry 2 is on the front of the machine and entry 1 on the top thereof). The advertizing insert/reply envelope entry 4 is defined behind the document entry 1 on the rear of the machine substantially at the level of the separation of the upper chassis 5A and lower chassis 5B and the filled and closed envelope exit 3 is defined below and to the front of the lower chassis 5B in front of the empty envelope entry.

To the document entry 1 there corresponds a path 10 of documents in the machine which feeds a functional module 15 for folding. The folding module 15 preferably presents two pockets for folding, an upper pocket 150 intended for making a first fold and a lower pocket 152 for making a second fold, associated with an assembly of four rollers 160 to 166 for folding, including a drive roller 160. This path 10 defines the path of the documents between the entry 1 and the entry of the folding module 15. It forms a substantially rectilinear line terminating in a bend guiding the documents from the entry 1 (on the top of the machine) towards a median or central part of the upper chassis 5A, in order to feed the folding module 15, partly mounted in a rear median part of the chassis 5A and partly likewise in a rear median part of the chassis 5B. This folding module 15 itself ensures, at the end of path 10, during the folding that it effects, a turn of the path of the documents towards the exit 3.

To the empty envelope entry 2 there corresponds a path 20 of the empty envelopes in the machine. This path 20 which, in the example illustrated, does not, during its path in the machine, intersect at any moment the path 10 of the documents, terminates in a front median part of the machine. This path defines the path of the empty envelopes from the entry 2 up to a first entry of a functional insertion module 25. Here it also forms a substantially rectilinear line terminating in a bend guiding the envelopes in the insertion module. It is equipped with a means for opening the flap of the empty envelopes (not shown).

To the insert or reply envelope entry 4 there corresponds a path 40 of the advertizing inserts or reply envelopes in the machine which takes these inserts or reply envelopes directly to a zone of formation of the second fold of document in the folding module 15, more precisely at the level of the entry of the second folding pocket 152. The path follows a substantially rectilinear path aligned with a second entry of the insertion module 25.

Finally, to the closed envelope exit 3 there corresponds a path 30 for filled envelopes. This path 30 is substantially linear and extends, between the upper and lower chassis 5A, 5B, from the front part of the machine to the front median part of the machine and it is aligned with the exit of the folding module 15 and substantially with the exit of the insert or reply envelope path 40. This path 30 is conventionally equipped with different modules which are mutually de-activated with the opening of the upper chassis 5A on lower chassis 5B, such as a functional module for loading the different articles in the empty envelopes (insertion module 31), a functional module for wetting the flaps and a module for folding and closing the flaps (these latter two modules not being shown).

A control circuit 6 defines the controls of the machine during a control cycle, in liaison if necessary with interface circuits 61, 62, 63 peculiar to the principal feeder 100, the secondary feeder 200 and the auxiliary feeder 400.

The feed magazines, which may for example be made of welded sheet meal, each conventionally comprise on a support plate 121, 131, 201, 401, two self-centred lateral margin stops 122, 132, 202, 402 (sliding in synchronism by a rack, not shown) and a mobile rear presser 123, 133, 203, 403. The support plate comprises on a part of its bottom a die 124, 134, 204, 404 constituted by an element coated with a rough coating to ensure separation/selection of the different articles (documents, empty envelopes, advert g inserts or reply envelopes) extracted from the corresponding magazine. Drive of these articles is effected by at least one roller, preferably two rollers 125, 126; 135, 136; 205, 206; 405, 406 for taking up articles, driven by a control motor 7 of the machine, via an assembly of drive pinions (not shown). It will be noted that, although the principal document feeder illustrated in FIG. 2 is constituted by three non-transformable tubs, one manual and two automatic, it is obvious that it may advantageously be replaced by an automatic feeder with two tubs of the type described in Application FR 2 714 633 and illustrated in FIG. 1.

Different sensors (not shown) are, of course, provided for conventionally ensuring correct functioning of the different feeders 100, 200, 400, in particular for detecting the entry in a path 10, 20, 40 for conveying the different articles (at the end of selection by the die), for forming the folds (at the level of the folding stops of the first and second pockets), for the presence of these articles (documents, empty envelopes, advertizing inserts or reply envelopes) in the different magazines, etc . . .

The two-pocket folding module 15 and the flap-opening, wetting and envelope closing modules are described in detail for example in European Patent EP 0 352 692 filed in Applicants' name.

Operation of the folding and/or inserting machine of known type is described with reference to the placing of two documents of format A4 accompanied by a reply envelope, in an envelope.

It will firstly be noted that the magazines 200 and 400 are easily accessible, the empty envelopes or the reply envelopes being stored in vertical position. These two types of envelopes are positioned simply in packets, by moving the rear presser away. The same applies to the document magazines advantageously located on the top of the machine.

During a first phase, the reply envelope is withdrawn from the magazine by the article take-up rollers 405, 406 and, after selection by the die 404, is entrained between conveying rollers/counter-rollers 407, 408 along the path 40 up to its exit at the level of roller 164 of the folding module 15 where it remains in stand-by position (a detector, not shown, allows this position to be determined and the drive motor means of the reply envelope cut (disengaged)). Of course, in order not to decrease the rate of the machine to an excessive degree, this first phase of operation will preferably be effected in parallel with the other operational phases of this machine. The second operational phase will be effected differently depending on whether this reply envelope is inserted alone in an empty envelope or together with documents. In the first case, the reply envelope is set in motion again when the empty envelope, extracted from the magazine 200 by the rollers 205, 206 and the die 204, is entrained by the pressure rollers/counter-rollers 207, 208 along the path 20 up to upstream of the first entry of the insertion module 25. In the second case, the documents which arrive upstream of the folding module 15 from the path 10, after having been successively extracted from the magazine 120 (and magazine 130) by the rollers 125, 126 (135, 136 respectively) and the die 124 (134), are entrained (via the conveyor rollers/counter-rollers 127, 128) by the rollers 160, 162 in the first folding pocket 150 then, after formation of a loop (resulting from the contact of the document with the folding stop 154 of this first pocket), they are entrained by the rollers 160, 164 into the second folding pocket 152 until they come into contact with the second folding stop 156 of this second pocket. At that instant (in terminal phase of folding), the reply envelope is again set in motion and inserted into the folding zone in order to be entrained with the documents by the rollers 160, 166 towards the second entry of the insertion module 25 at the entry of the path 30. Of course, the process described hereinbefore may equally well be applicable to a document issuing from the manual introduction plate 110. It will be noted that the stops 154, 156 are adjustable, by a translation along each pocket, to choose the position of the first and second folds.

It will be readily understood that, with this type of folding and/or inserting machine, it is difficult to put both an insert and a reply envelope in an envelope at the same time. In effect, in that case, it proves necessary use to a document tub by way of insert feeder, which, on the one hand, is possible only for inserts of sufficient dimensions and, on the other hand, involves a passage (passage via the folding pockets) of the folding module.

Figure 1:
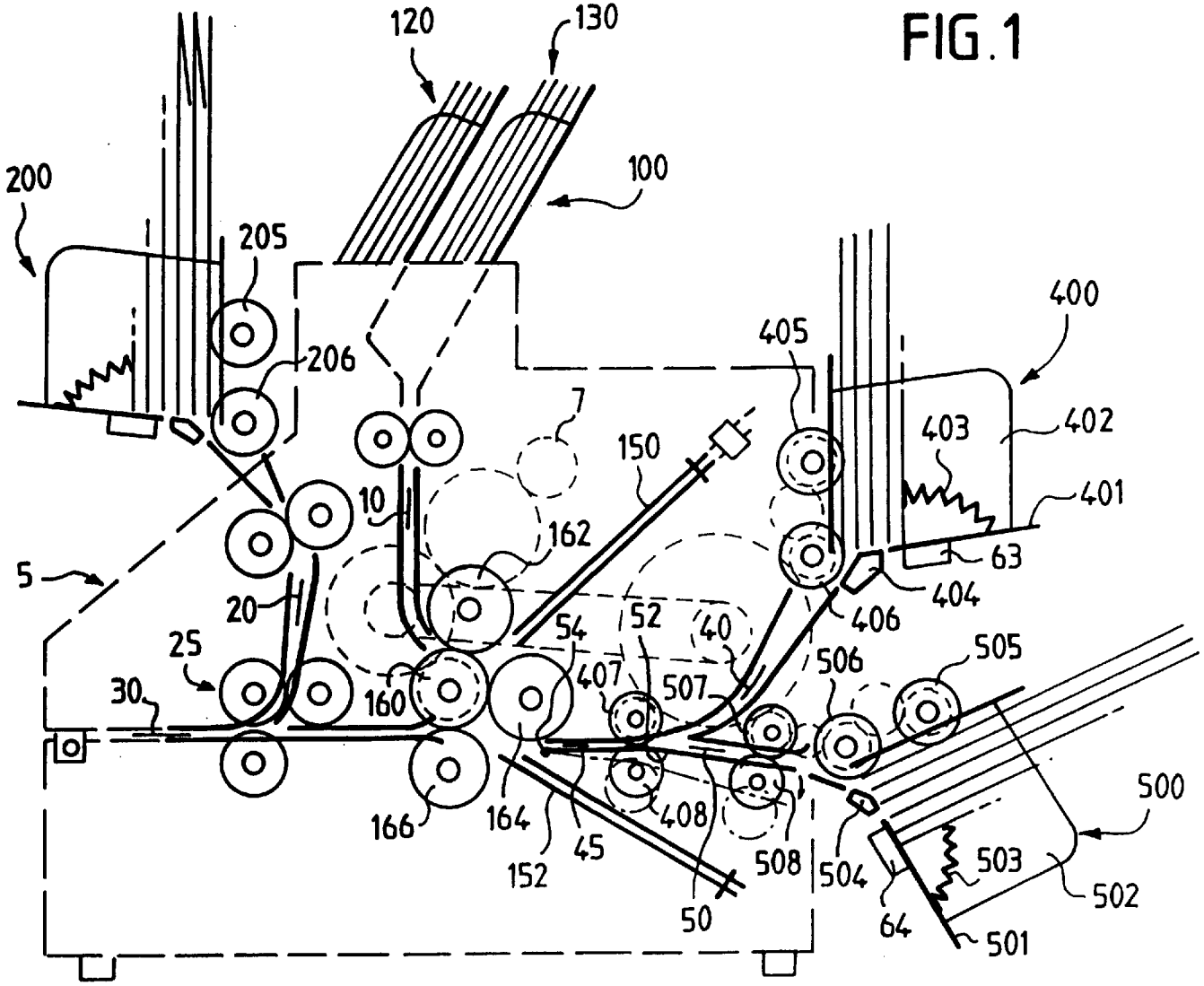
FIG. 1 very schematically shows a first embodiment of a folding and/or inserting machine according to the invention, and FIG. 2 schematically shows an embodiment of a folding/inserting device of the prior art.

It is thus proposed according to the invention to add to the four conveyor paths of such a known machine a fifth path connected to a new advertizing insert or reply envelope entry. The structure of a folding and/or inserting machine thus improved is schematically shown in FIG. 1.

The essential elements composing a conventional four-path machine are, of course, found again. These elements which will not be described again bear the same references. In particular, there corresponds to a first insert or reply envelope entry 4, the adverting insert or reply envelope path 40 in the machine which takes these inserts or reply envelopes directly to the zone of formation of the second document fold in the folding module 15, more precisely at the level of the entry of the second folding pocket 152. This path, in a terminal part 45 which is adjacent the entry of this second folding pocket, follows a substantially rectilinear path aligned with the second entry of the insertion module 25. According to the invention, there corresponds to a second insert or reply envelope entry 5, a second path 50 for the advertizing inserts or reply envelopes which also takes these inserts or reply envelopes directly to the zone of formation of the second document fold in the folding module 15, more precisely at the level of the entry of the second folding pocket 152. This path joins in its terminal part the terminal part 45 of the first insert path 40 (these two paths thus presenting a Y-configuration) and therefore follows at the level of this common terminal part a substantially rectilinear path aligned with the second entry of the insertion module 25.

In order to facilitate a possible unblocking, in the event of blocking of an insert or a reply envelope in the insert/reply envelope paths, the second insert/reply envelope conveying path 45, 50 is formed by two half-conduits of which one, preferably a lower half-conduit 52, is articulated about a pin 54 to allow it to be lowered (by locking/unlocking means, not shown) and therefore to facilitate access to the interior of this path.

The insert or reply envelope entry 5 is located at the base of a second auxiliary feeder 500 comprising a magazine of advertizing inserts/reply envelopes in which the advertizing inserts or the reply envelopes are introduced in packets, as for the other feeders. This second advertizing insert or reply envelope magazine 500 is defined behind the first insert/reply envelope entry 4 on the rear of the machine below the first magazine 400. This second magazine 500 presents a structure advantageously similar to that of the first magazine 400 with a support plate 501, two self-centred lateral margin stops 502 (sliding in synchronism by a rack, not shown) and a mobile rear presser 503. The support plate comprises on a part of its bottom a die 504 constituted by an element coated with a rough coating for ensuring separation/selection of the different articles (advertizing inserts or reply envelopes) extracted from the magazine 500. These articles are entrained by at least one roller, preferably two rollers 505, 506 for taking up articles, driven by the control motor 7 of the machine. Inside the machine, like the rollers 407 and 408 associated with path 40, rollers 507, 508 for taking up the articles are provided at the entry of the path 50. It will be noted that these rollers comprise drive rollers 407, 507 and simple pressure rollers (counter-rollers) 408, 508. The former are connected to the control motor 7 of the machine through control kinematics (with, in particular drive pinions and belt) shown in dashed and dotted lines in FIG. 1, and the latter are mobile with the lower half-conduit 52 of which they follow the downward displacement.

Control of the feeder 500 is ensured through an interface 64 with the control circuit 6 of the machine and different sensors (not shown) are conventionally provided to ensure correct functioning of this feeder, in particular to detect the presence of advertizing inserts or reply envelopes in the magazine or the entry and advance in the conveyor path 50 of the machine (at the end of the selection by the die, for example).

Thus, with the folding and/or inserting machine according to the invention, the problems raised by the placing of advertizing inserts and reply envelopes in an envelope at the same time, are solved. In addition, the presence of this second insert or reply envelope feed tub makes it possible to increase the insert or reply envelope loading capacity if only one of these types of articles is required, provided that the loading capacity of the empty envelopes is increased accordingly. In addition, due to the positioning of this second tub under the first, in the immediate proximity of the central insertion zone, the general space requirement of the machine is not increased (or only in small proportions) and its initial compact architecture is thus preserved. The performances of the machine are globally improved while maintaining its initial versatility.

What is claimed is:

1. Folding and/or inserting machine of the type comprising a first path coupled upstream to a document entry and downstream to a first entry of a folding module, a second path coupled upstream to an empty envelope entry and downstream to a first entry of an insertion module which is coupled downstream of an exit of the folding module, a third path coupled upstream to an exit of the insertion module and downstream to a filled and closed envelope exit, and a fourth path coupled upstream to a first advertising insert or reply envelope entry and downstream to a second entry of the insertion module, a fifth path coupled upstream to a second advertising insert or reply envelope entry and downstream to the second entry of the insertion module, the routing of the advertising inserts or the reply envelopes along the fourth and fifth paths between the advertising insert or reply envelope entries and the second entry of the insertion module being effected through the folding module without passage through the folding pockets.

2. The folding and/or inserting machine of claim 1, wherein the second advertizing insert or reply envelope entry is arranged beneath the first advertizing insert or reply envelope entry to the rear of the machine.

3. The folding and/or inserting machine of claim 1, wherein the first and second advertizing insert or reply envelope paths form a conveying path having a general Y configuration with a common terminal part which follows a substantially rectilinear path aligned with the second entry of the insertion module.

4. The folding and/or inserting machine of claim 3, wherein said conveying path is formed by two half-conduits including a lower half-conduit articulated about a pin to allow access inside the conveying path after it has tipped downwardly.

5. The folding and/or inserting machine of claim 1, wherein said lower half-conduit is provided with pressure rollers which cooperate with drive rollers associated with an upper half-conduit of the path for conveying the advertising inserts or reply envelopes and actuated from the control motor of the machine.

* * * * *